US005732815A

United States Patent [19]

Brouwer

[11] Patent Number: 5,732,815

[45] Date of Patent: Mar. 31, 1998

[54] CIRCUIT BREAKER LOCKOUT DEVICE

[75] Inventor: John J. Brouwer, Dyer, Ind.

[73] Assignee: Panduit Corp., Tinley Park, Ill.

[21] Appl. No.: 696,282

[22] Filed: Aug. 13, 1996

[51] Int. Cl.[6] ..... H01H 9/28

[52] U.S. Cl. ..... 200/43.14; 200/43.11

[58] Field of Search ..... 200/43.14, 43.11, 200/43.15, 43.19, 43.16, 43.21

[56] References Cited

U.S. PATENT DOCUMENTS 2,849,552 3/1958 Firestone .

5,079,390 1/1992 Costanzo et al. ..... 200/43.14

5,147,991 9/1992 Jordan, Sr. .

5,300,740 4/1994 Bende ..... 200/43.14

5,500,495 3/1996 Benda et al. ..... 200/43.14

*Primary Examiner*—David J. Walczak

*Attorney, Agent, or Firm*—Mark D. Hilliard; Robert A. McCann

[57] ABSTRACT

A circuit breaker lockout device for securing a toggle switch of a circuit breaker includes a pivotable thumb screw for selectively engaging a set screw for securing the lockout device to the toggle switch and including a shackle to prevent inadvertent removal of the lockout device.

12 Claims, 3 Drawing Sheets

CIRCUIT BREAKER LOCKOUT DEVICE

TECHNICAL FIELD

The present invention relates to a toggle lockout and more particularly to a simple toggle switch lockout device for locking a toggle switch such as a circuit breaker switch in either the on or off position.

BACKGROUND OF THE INVENTION

The desire to maintain the setting of certain toggle switches in either the "on" or "off" position has existed for many years. More recently, the Occupational Safety and Health Administration (OSHA) has placed in effect rules which require that energy sources be locked out prior to any work being performed on an electrical circuit. These rules are intended to prevent injuries resulting from someone turning on the power while maintenance or other work is being done on that circuit. A variety of circuit breaker lockout devices are known in the art and generally include a housing which is positioned over the toggle switch and prevents movement of the toggle switch as well as having apertures through which a shackle of a lock can be inserted to prevent removal of the lockout device.

Prior circuit breaker lockout devices have included multi-part assemblies which slidingly engage the toggle switch or have simply used a set screw to secure the toggle switch as shown in U.S. Pat. No. 2,849,552. All of these prior art devices require additional steps for the engagement of the multiple parts or operations using additional tools to secure the device.

SUMMARY OF THE INVENTION

It is therefore an object of the present invention to provide an improved toggle switch lockout device.

It is a further object of the invention to provide a simplified toggle switch lockout device which does not require any additional tools.

In general, the toggle switch lockout device of the present invention includes a casing member having an opening for positioning around the toggle switch including stop means for preventing rotation of said switch, securing means for removably securing the casing member to the toggle switch, drive means linked to the securing means for driving the securing means into engagement with the toggle switch, wherein the drive means is selectively is movable between an operable driving position and an inoperable position, and shackle accepting means for receiving a shackle of a lock in a position such that the drive means is prevented from movement into the operable driving position.

DESCRIPTION OF THE PREFERRED EMBODIMENT

Figure 1:
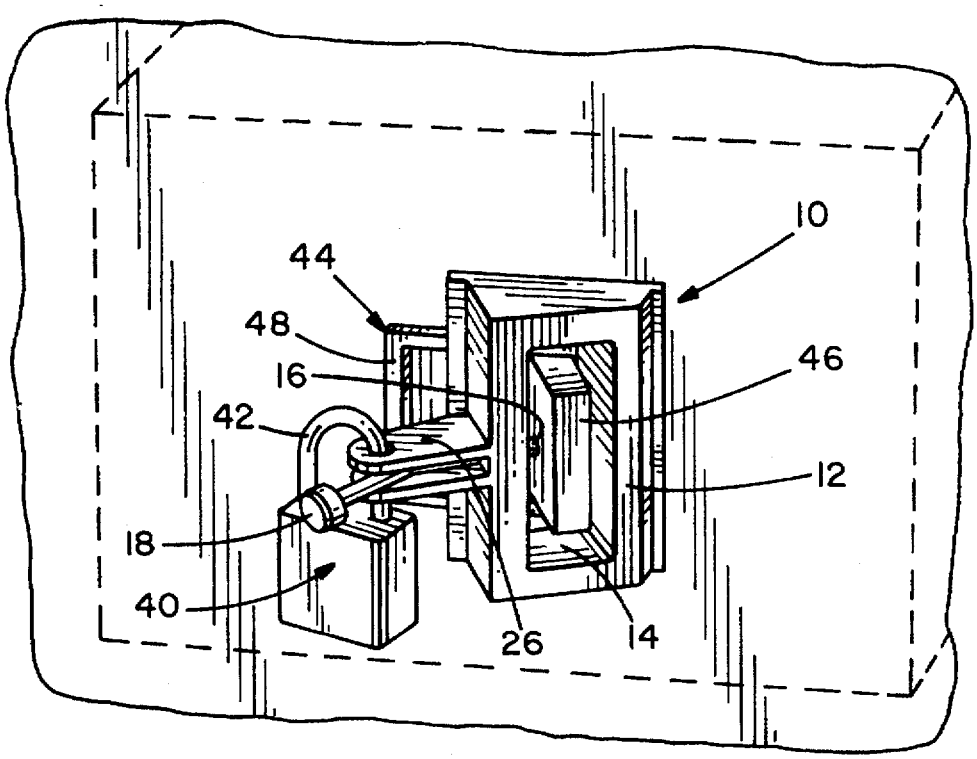
FIG. 1 is a perspective view of the lockout device of the present invention shown engaged to a circuit breaker switch.
Figure 2:
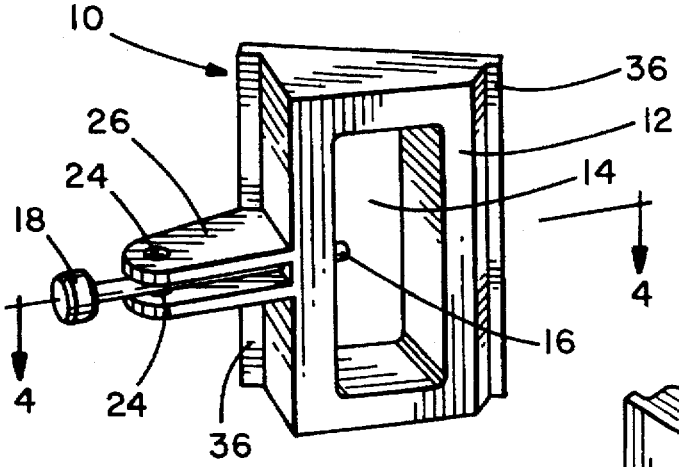
FIG. 2 is a front perspective view of the lockout device of the present invention.
Figure 3:
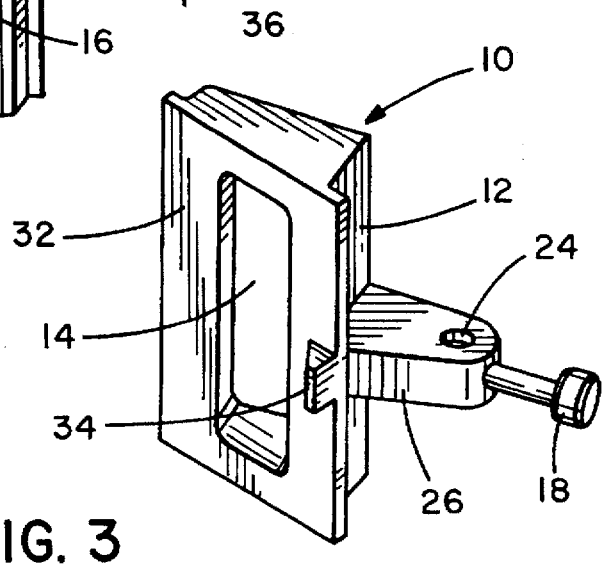
FIG. 3 is a rear perspective view of the lockout device of FIG. 2.
Figure 4:
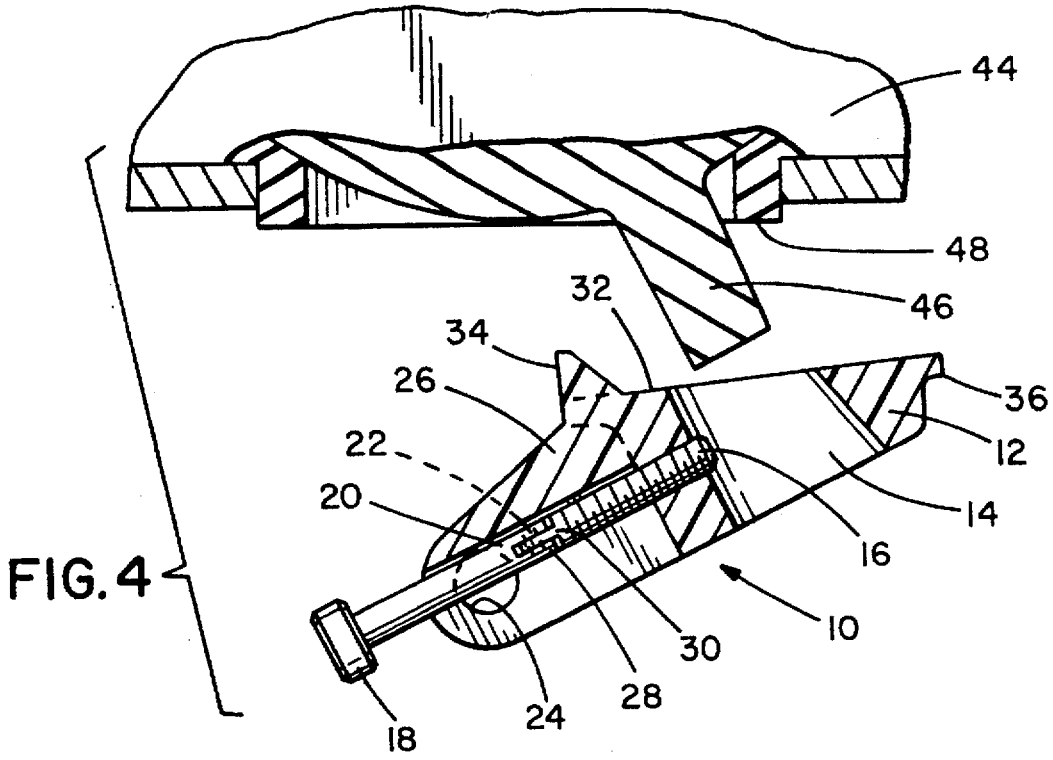
FIG. 4 is a sectional view of the lockout device taken along lines member is made of plastic.
Figure 5:
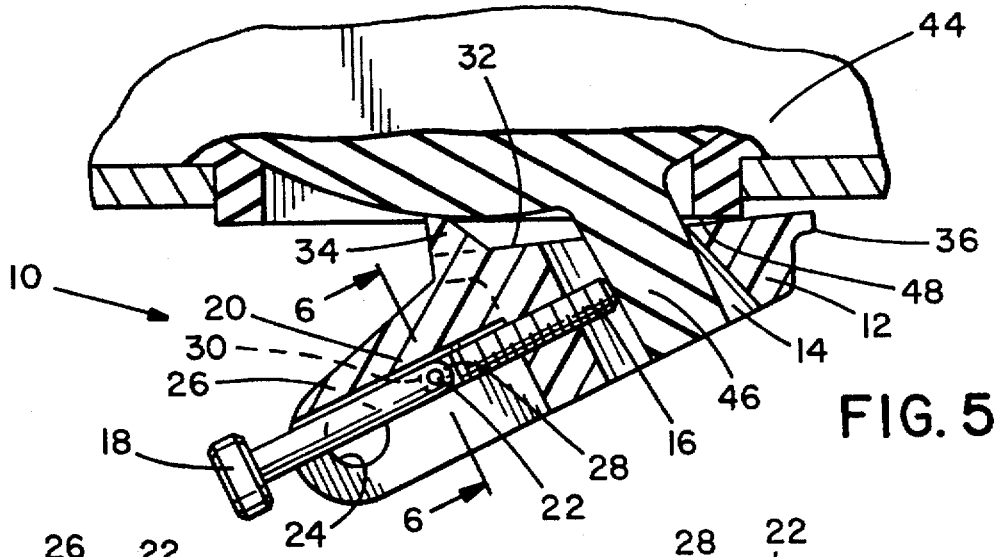
FIG. 5 is a sectional view of the lockout device of FIG. 4 shown engaged with the toggle switch.
Figure 6:
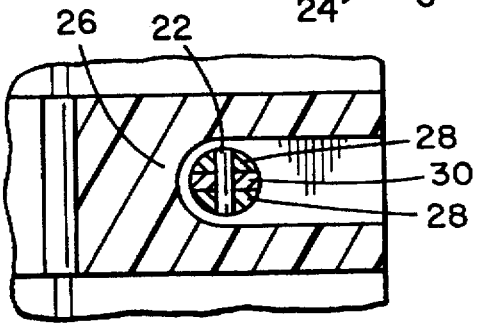
FIG. 6 is a sectional view of the lockout device taken along the lines 6—6 of FIG. 5.
Figure 7:
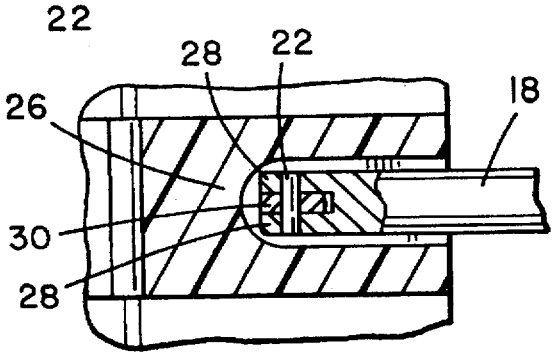
FIG. 7 is a sectional view of the lockout device taken along lines 7—7 of FIG. 8.
Figure 8:
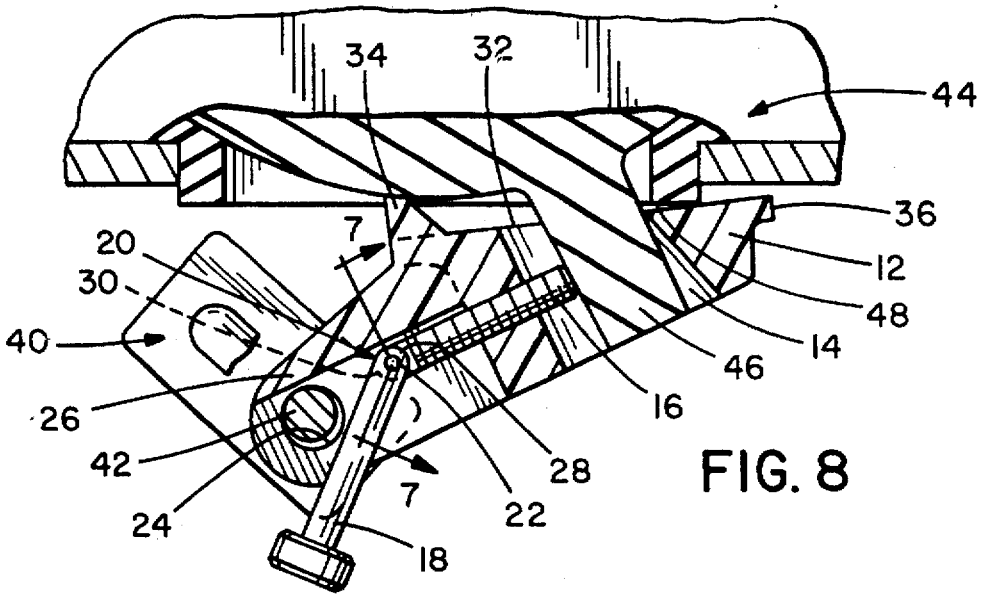
FIG. 8 is a sectional view of the lockout device as shown in FIG. 5 with a shackle applied.
Figure 9:
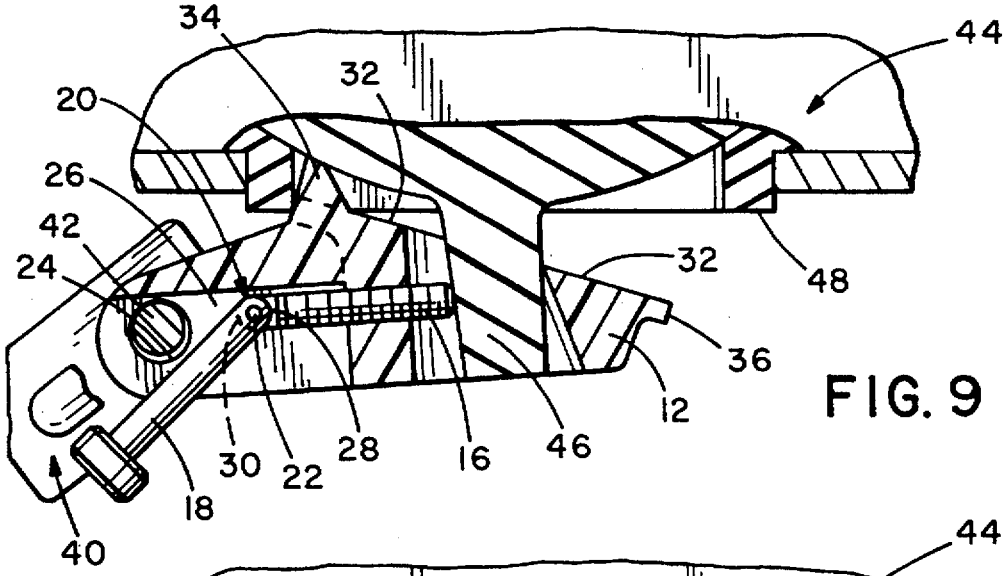
FIG. 9 is a sectional view of the lockout device of FIG. 8 shown preventing the switch from changing positions.

A lockout device embodying the concept of the present invention is designated generally by the reference numeral 10 in the accompanying drawings. As shown in FIG. 1, lockout device 10 includes a casing 12 having a switch accepting opening 14 for placement over a circuit breaker lockout switch 46. As can be seen in FIGS. 1–3, casing 12 includes a flat bottom side 32 for positioning lockout 10 against the top surface 48 of the circuit breaker. A switch accepting opening 14 is disposed through the casing 12 at an angle which substantially corresponds to the angle at which switch 46 projects from the top surface of the circuit breaker 48. A brake cleat 34 is also provided extending from the bottom side 32 of the lockout device to provide a more positive stop on circuit breakers with a rib or edge to catch on. As shown in FIG. 3, the casing 12 is also provided with a strengthening rib along the outer bottom wall to add strength to the casing 12 and prevent bowing under pressure.

As shown in FIGS. 4–7, the lockout device 10 also includes a set screw 16 extending through a wall of the casing 12 and disposed substantially perpendicular to the switch opening 14. Set screw 16 is surrounded on three sides by a screw protecting portion 26 integrally formed with lockout casing 12. A first end of the set screw 16 is intended to be driven against switch 46 in order to secure the lockout device 10 to the switch 46. A second opposite end of set screw 16 is a rod end 30 of a knuckle joint 20, also known as a clevis or U-joint, that includes a pin aperture. A thumb screw 18 is attached to the rod end 30 by way of a yoke end 28 having a pair of flange portions that also include pin apertures. The flange portions of the yoke end 28 are disposed on each side of the rod end and secured thereto by a pin 22 inserted there between. The knuckle joint 20 allows for the thumb screw 18 to be pivoted in and out of alignment with the set screw 16 from an operable in-line driving position to an inoperable position in which the set screw 16 can not be turned.

In use lockout device 10 is placed over the switch 46 in either the "on" or "off" position depending on which position it is desired to remain. The thumb screw 18 is pivoted into an operable position and rotated to drive the set screw 16 into engagement with toggle switch 46 to secure switch 46 in the desired position. Thumb screw 18 is then pivoted into a non-operable position and away from the shackle receiving apertures 24 formed on the screw protecting portion 26. A shackle 42 of a lock 40 is inserted through apertures 24 and engaged to the lockout casing 12. This prevents thumb screw 18 from being moved into the operable position to thereby prevent removal of the lockout device 10 from the electrical switch 46.

Figure 10:
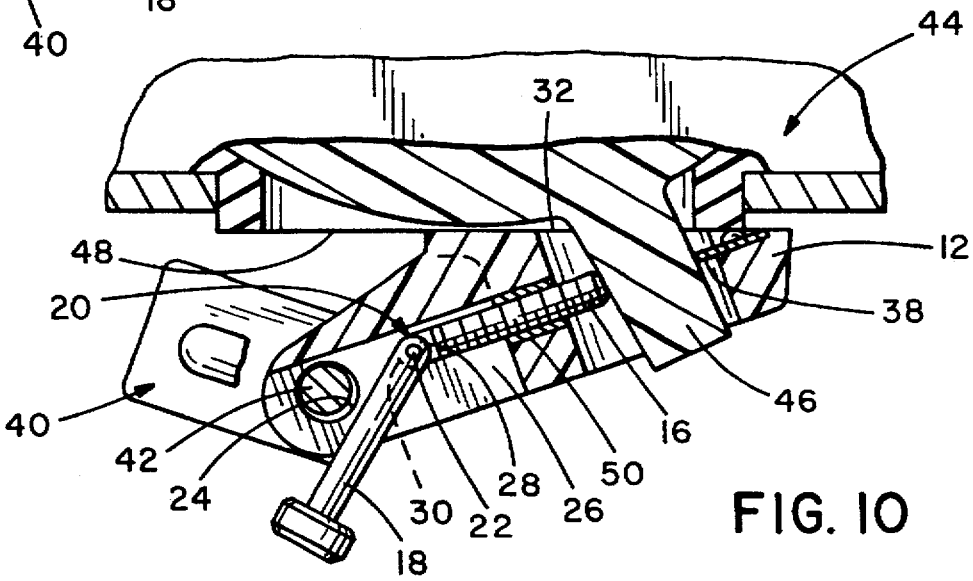
FIG. 10 is a sectional view of a second embodiment of the lockout device of the present invention.

FIG. 10 shows another embodiment of the present invention that includes a metal plate 38 embedded into a wall of the casing 12 on the opposite side of set screw 16. Metal plate 38 helps to securely engage the switch 46 and provide increased strength to the lockout device 10. The lockout device of FIG. 10 also is shown with the optional brake cleat 34 removed from the bottom side 32 of lockout device 10. Additionally, the lockout device of FIG. 10 includes a threaded insert 50 disposed within a casing wall for receiving the set screw 16. Threaded insert 50 provides for additional strength and allows for easier threading of set screw 16.

It is to be noted that while the present invention has been shown and described as being used on a circuit breaker toggle switch, it is intended for use on any of the commonly known toggle type switches.

Furthermore, while the particular embodiments of the present invention have been shown and described, it will be obvious to those skilled in the art that changes and modifications may be made without departing from the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A switch lockout device for preventing a toggle switch from being rotated, comprising:

a casing member having an opening for positioning around the toggle switch including stop means for preventing rotation of said switch;

securing means for removably securing the casing member to the toggle switch;

drive means linked to the securing means for driving the securing means into engagement with the toggle switch, wherein the drive means is a thumb screw pivotally connected to the securing means by a joint and is selectively movable between an operable driving position and an inoperable position; and shackle accepting means for receiving a shackle of a lock in a position such that the drive means is prevented from movement into the operable driving position.

2. A switch lockout device according to claim 1, wherein the casing member is made of plastic.

3. A switch lockout device according to claim 1, wherein the joint is a knuckle joint.

4. A switch lockout device according to claim 1, wherein the stop means includes a brake cleat formed on an underside of the casing member.

5. A switch lockout device according to claim 1, wherein the securing means is a set screw positioned within a wall of the casing.

6. A switch lockout device according to claim 5, further including a threaded insert positioned within the casing member so as to engagingly surround a portion of the set screw.

7. A switch lockout device for preventing a toggle switch from being rotated, comprising:

a casing member having an opening situated to allow for positioning of the casing member around the toggle switch;

securing means for removably securing the casing member to the toggle switch;

a drive screw pivotally coupled to the securing means by a joint and movable between an operable driving position and an inoperable position; and an aperture for receiving the shackle of a lock disposed so as to prevent the drive screw from being moved into the operable driving position.

8. A switch lockout device according to claim 7, wherein the casing member is made of plastic.

9. A switch lockout device according to claim 7, wherein the joint is a knuckle joint.

10. A switch lockout device according to claim 7, further including a brake cleat projecting from an underside of the casing member.

11. A switch lockout device according to claim 7, wherein the securing means is a set screw positioned within a wall.

12. A switch lockout device according to claim 11, further including a threaded insert positioned within the casing member so as to engagingly surround a portion of the set screw.

* * * * *